US005249798A

United States Patent [19]

Miyamoto

[11] Patent Number: 5,249,798

[45] Date of Patent: Oct. 5, 1993

[54] TENNIS RACKET FRAME

[75] Inventor: Kenichi Miyamoto, Akashi, Japan

[73] Assignee: Sumitomo Rubber Industries, Ltd., Hyogo, Japan

[21] Appl. No.: 910,523

[22] Filed: Jul. 8, 1992

[30] Foreign Application Priority Data

Jul. 9, 1991 [JP] Japan ..... 3-168333

[51] Int. Cl.[5] ..... A63B 49/02

[52] U.S. Cl. ..... 273/73 C; 273/73 R

[58] Field of Search ..... 273/73 R, 73 C, 73 E, 273/73 F, 73 H, 73 K, 73 A, 73 B

[56] References Cited

U.S. PATENT DOCUMENTS 4,768,786 9/1988 Kuebler ..... 273/73 C
4,861,029 8/1989 Takatsuka ..... 273/73 C
5,152,526 10/1992 Soong ..... 273/73 R X

FOREIGN PATENT DOCUMENTS 0171500 2/1986 European Pat. Off. ..... 273/73 C
0176021 4/1986 European Pat. Off. ..... 273/73 C
89/10774 11/1989 World Int. Prop. O. ..... 273/73 C

*Primary Examiner*—William Stoll
*Attorney, Agent, or Firm*—Birch, Stewart, Kolasch & Birch

[57] ABSTRACT

A tennis racket which includes a main frame portion having an oval shape which is defined by a top portion, side portions; and a yoke portion, a grip portion contiguous with the yoke portion, and a netting stretched in the oval main frame by main strings and cross strings to form a ball striking face with a sweet area provided therein, wherein the ratio of the rigidity in the ball striking direction, which is the thickness direction of the frame to the rigidity in the main string direction, and the ratio of the rigidity in the ball striking direction, which is the thickness direction of the frame, to the rigidity in the cross string direction, are each set to be larger than 1.00 and smaller than 2.00, and the rigidity ratio of the frame within the ball striking face including the ratio of the rigidity in the main string direction to the rigidity in the cross string direction of said strings is set to be smaller than 1.00.

4 Claims, 4 Drawing Sheets

TENNIS RACKET FRAME

BACKGROUND OF THE INVENTION

The present invention generally relates to a tennis racket and more particularly, to a tennis racket frame intended to improve its repulsion performance, i.e. the flying performance of a ball, which is an important characteristic of a tennis racket.

Recently, in connection with tennis racket frames, freedom for designing has been enlarged due to molding thereof by a fiber reinforced plastic such as a carbon fiber reinforced plastic, with a consequent result of higher performance. By way of example, there has been provided a so-called "large-sized racket" increased in its ball striking area, or "wide body" and with a larger thickness in the ball striking direction, whereby a wider application is achieved.

The fact that tennis rackets of the above described type have been widely employed, shows that in tennis play, except for some limited high class players capable of controlling speed and ball power, as desired, the most important performance required for tennis players in order to play comfortably is the repulsion performance, i.e. the flying performance of the ball after it strikes the strings.

It is self-evident that, during actual play, the respective functions of the ball, the tennis racket frame, and the strings act in concert with to each other in producing the phenomenon which defines the way in which "the ball flies". Although detailed functions in such interactions are not fully clarified, it has been found that conversion of energy at the point of collision between the ball and the racket, into kinetic energy is essential for flying the ball, and for this purpose, the rigidity or stiffness of the racket frame and the position of the sweet area on the ball striking face is very important.

With respect to the rigidity as referred to above, the rigidity in the direction from where the struck ball comes flying, and in the ball striking face outer direction which is the direction wherein the ball is driven back after having collided with the tennis racket, i.e. the rigidity in the direction of thickness of the frame, and the rigidity in the ball striking face inner direction, which intersects at right angles with the above ball striking face outer direction, i.e. the rigidity in the direction of the main strings and that in the direction of the cross strings, are important.

For the rigidity of the racket frame as described above, various proposals have been made up to the present, each of which, however, is limited to an improvement only with respect to either the rigidity in the ball striking face outer direction or in the ball striking face inner direction. For example, in a conventional racket frame disclosed in Japanese Patent Laid-Open Publication Tokkaisho No. 62-231682, it is intended to increase the rigidity in the ball striking face inner direction for improving the repulsion performance by positionally varying the geometrical moment of inertia of the frame or by partially reinforcing the fibers.

However, in order to improve the repulsion performance by increasing the rigidity of the racket frame, it has been found necessary to take into account, both the rigidity in the ball striking face inner direction and the ball striking face outer direction, instead of improving only one of such rigidities.

Meanwhile, with respect to the sweet area in the ball striking face, since the speed of the ball striking face in the striking direction becomes faster in the upper portion of the ball striking face than in the lower portion thereof during the the actual play (or during swing), i.e. in the forward end side (the top portion side) than in the hand-held side (the yoke side) of the racket frame in rotational speed, it is possible to transfer a larger kinetic energy to the ball by selecting a position of a striking point of the sweet area designed to provide the maximum repulsion coefficient, to be at a higher position in the ball striking face for striking the ball at said sweet area, thereby improving the repulsion performance of the racket frame.

In conventional racket frames in general, the sweet area is set at a position located somewhat at a lower side (yoke portion side) from the center of the ball striking face, by taking into account the facilitation of ball striking. As described above, since the sweet area where the repulsion coefficient becomes a maximum is set towards the side of the yoke portion from the center of the ball striking face, the rotational speed of the swing can not be effectively utilized, with a consequent deterioration in the repulsion coefficient.

As described so far, in tennis racket frames conventionally proposed or provided, there has been room for improvement from the viewpoint of the repulsion performance, with respect to the rigidity of the frame and the position of the sweet area, and it is expected that the flying performance of the ball may be improved by improving the above points.

SUMMARY OF THE INVENTION

Accordingly, an essential object of the present invention is to provide a tennis racket frame which is remarkably improved in its flying performance, by imparting to the racket frame, the most suitable rigidity for improving the repulsion performance thereof, and by positioning a sweet area so as to be capable of effectively utilizing the rotational speed during the swing.

Another object of the present invention is to provide a tennis racket of the above described type which can be readily manufactured through a simple process on a large scale low cost.

In accomplishing these and other objects, according to one preferred embodiment of the present invention, there is provided a tennis racket which comprises a main frame portion having an oval shape, which is defined by a top portion, side portion; and a yoke portion, a grip portion contiguous with the yoke portion, and a netting stretched in the oval main frame by main strings and cross strings to form a ball striking face with a sweet area provided therein, wherein the ratio of the rigidity in the ball striking direction, which is the thickness direction of the frame (rigidity in an outer direction of the ball striking face) to the rigidity in the main string direction of the strings intersecting at right angles with said ball striking direction (i.e. rigidity in the main string direction/rigidity in the ball striking direction), and the ratio of the rigidity in the ball striking direction, which is the thickness direction of the frame (rigidity in an outer direction of the ball striking face) to the rigidity in the cross string direction (rigidity in an inner direction of the ball striking face) (i.e. rigidity in the cross string direction/rigidity in the ball striking direction), are each set to be larger than 1.00 and smaller than 2.00, and the rigidity ratio of the frame within the ball striking face including the ratio of the rigidity in the main string direction to the rigidity in the cross string direction of said strings is set to be smaller than 1.00.

The range for the ratio of the rigidity in the ball striking face outer direction to that in the ball striking face inner direction, and the range of the rigidity ratio of the frame within the ball striking face are established based on results of experiments in which the present inventor measured the repulsion coefficients through variation of the rigidity in the respective directions of the racket frame.

It is to be noted that when the rigidity of the frame is set outside the range of the above values, deflections in the ball striking face inner direction and in the ball striking face outer direction resulting from the rigidity of the frame, produce vibration or torsion in the ball striking face, thus reducing the repulsion coefficient for flying the ball. Conversely, when the rigidity of the frame is set within the range of the above numerical values, the favorable deflections in the ball striking inner direction and in the ball striking outer direction, more effective for flying the ball, are generated, while almost no vibrations or torsion in the ball striking face is produced, thus increasing the repulsion coefficient.

Moreover, according to the present invention, the tennis racket frame is formed to have a shape in which the ratio of a radius of curvature at the top portion to the radius of curvature at the yoke portion is in larger than 1.20 and smaller than 1.50.

Furthermore, in the tennis racket frame of the present invention, the position of maximum lateral width for the ball striking face is set, between the central point of the ball striking face and the top portion of the frame, at an upper position within a range of 8 to 30% towards the top portion.

As described above, by setting the configuration of the tennis racket frame so that the ratio of the radius of curvature at the top portion to the radius of curvature at the yoke portion falls within the above range and/or the maximum lateral width position of the ball striking face is in the above range, the sweet area of the ball striking face is set at a position higher than that in the conventional arrangement, for effectively utilizing the rotational speed during the swing.

It is to be noted here that in the case where the value for the frame shape is set outside of the above range, since the position where the repulsion coefficient becomes a maximum is located lower than the center of the ball striking face, the rotational speed during the swing cannot be effectively utilized, with consequent deterioration in the repulsion coefficient. On the contrary, upon establishing the value within the above range, the position where the repulsion coefficient becomes a maximum, i.e. the sweet area, is located higher then the center of the ball striking face and thus, the rotational speed during the swing may be effectively utilized for increasing the repulsion coefficient.

The range of the ratio of the top portion to the yoke portion in the radius of curvature, and the position of the maximum lateral width for the ball striking face as described above have been obtained by the present inventor from results of experiments in which the repulsion coefficients were measured through alterations of the ratio of the radius of curvature and the position for the maximum lateral width.

As is seen from the foregoing description, in the rigidity of the racket frame, by setting the ratio of the rigidity in the ball striking face inner direction, to the rigidity in the ball striking face outer direction (ball striking direction), and the ratio of the rigidity of the frame in the ball striking face, within the range as described above, the deflection in the ball striking face outer direction and the ball striking face inner direction during the swing can be effectively utilized for flying the ball, thus resulting in an improvement in the repulsion coefficient. These results are confirmed by experiments as shown in Table 1 provided later.

Similarly, in the configuration of the racket frame, by setting the ratio of its top portion to the yoke portion thereof in the radius of curvature, and the maximum lateral width position in the ball striking face, within the ranges as referred to above, thereby displacing the sweet area towards the upper portion of the ball striking face, the rotational speed during the swing can be effectively utilized for improving the repulsion coefficient, which is also confirmed as shown later in Table 1 from the results of experiments.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
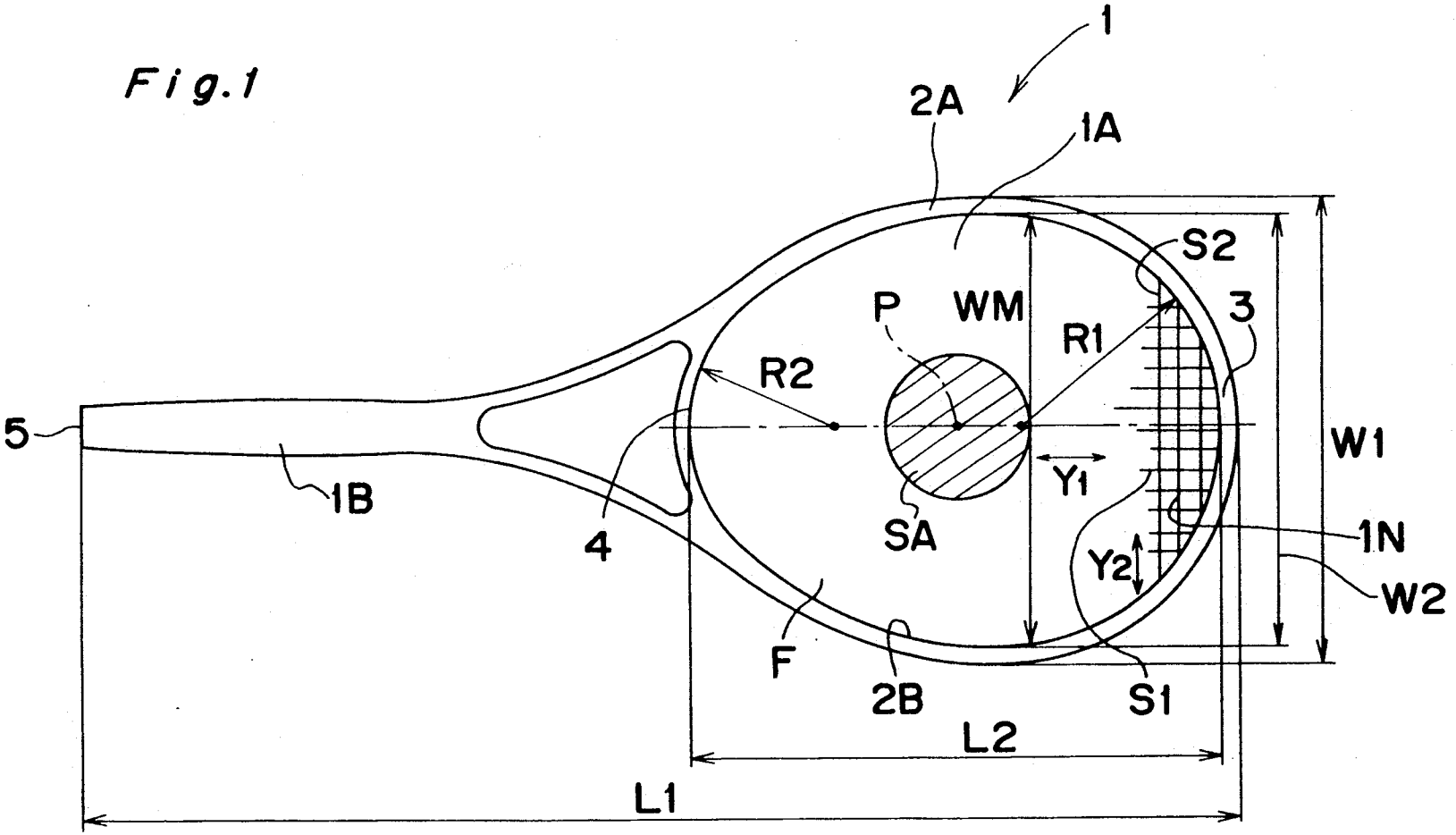
FIG. 1 is a schematic top plan view of a tennis racket frame according to one preferred embodiment of the present invention.

Before the description of the present invention proceeds, it is to be noted that like parts are designated by like reference numerals throughout the accompanying drawings.

Figure 2:
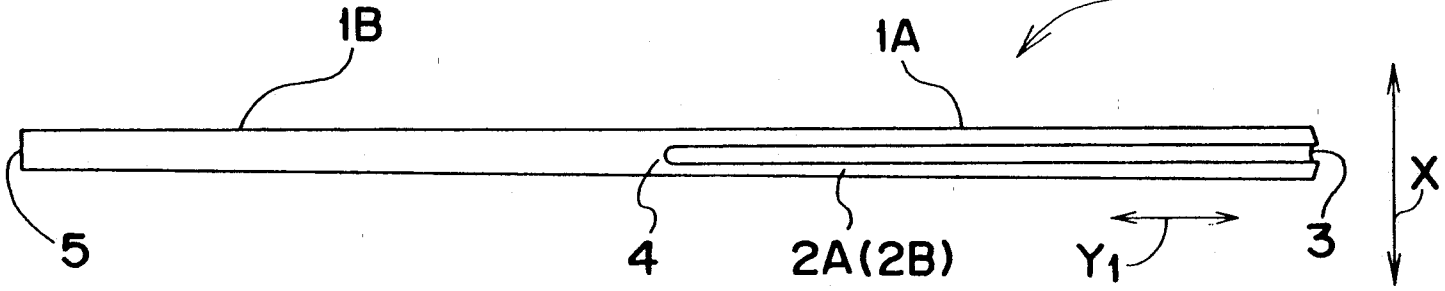
FIG. 2 is a side sectional view of the tennis racket frame of FIG. 1, FIGS. 3 to 5 are schematic diagrams for explaining a rigidity measuring method for the tennis racket frame.

Referring now to the drawings, there is shown in FIGS. 1 and 2, a tennis racket frame 1 according to one preferred embodiment of the present invention, which generally includes a main frame portion 1A of an oval shape, which is defined by a top portion 3, side portions 2A and 2B, and a yoke portion 4, a grip portion 1B contiguous to the yoke portion 4, and a netting 1N stretched in the oval main frame 1A by main strings S1 and cross strings S2 to define a ball striking face F with a sweet area SA provided therein.

As shown in FIG. 1, the tennis racket frame 1 has a total length L1 of 685 mm from the outer face of the top portion 3 to a distal end 5 of the grip portion 1B, a maximum lateral width between external faces of the oval main frame 1A for ball striking face F, i.e. an outer maximum lateral width W1 of 271.6 mm between the external faces at side portions 2A and 2B, an inner maximum lateral width W2 of 249.6 mm between internal faces of the side portions 2A and 2B, a length L2 of 328 mm between internal faces of the top portion 3 and the yoke portion 4, and a weight of the frame of 330 g, with a position for the center of gravity thereof being set at 300 mm from the grip end 5.

The tennis racket frame 1 is molded by laminating pre-impregnated or "pre-preg" sheets made of carbon fibers impregnated with epoxy resin.

To the top portion 3, side portions 2A and 2B, and yoke portion 4 which define the ball striking face F of the frame 1, a load in the ball striking face outer direction (indicated by an arrow X in FIG. 2) and another load in the ball striking face inner direction (indicated by arrows Y1 and Y2) are applied upon hitting the ball, and a cross sectional shape and the material of the frame 1 are set so that the rigidity of the frame with respect to such loads is in a range as follows.

Namely, the ratio of the rigidity in the ball striking face outer direction X (rigidity in the ball striking direction) to the rigidity in the ball striking face inner direction Y intersecting at right angles with said ball striking face outer direction X, and more specifically, the ratio of the rigidity in the direction Y1 of the main strings S1, to the rigidity in the direction Y2 of the cross strings S2 stretched in the ball striking face F, i.e. "the rigidity in the main string direction/the rigidity in the ball striking direction" and "the rigidity in the cross string direction/the rigidity in the ball striking direction", are each set in the range between a value larger than 1.00 and a value smaller than 2.00, while the rigidity ratio of the frame within the ball striking face consisting of the ratio of "the rigidity in the main string direction Y1/the rigidity in the cross string direction Y2" is set to be smaller than 1.00.

Figure 3:
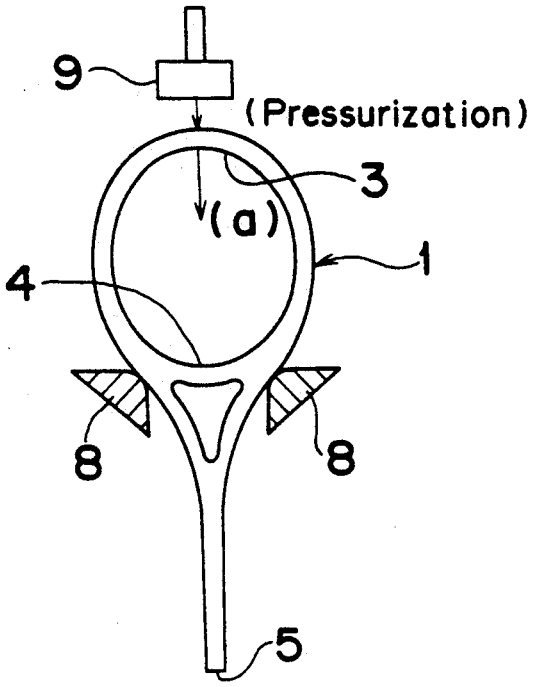
Figure 4:
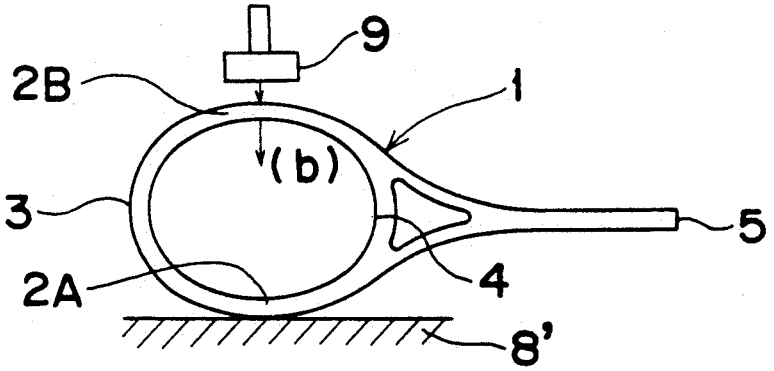
Figure 5:
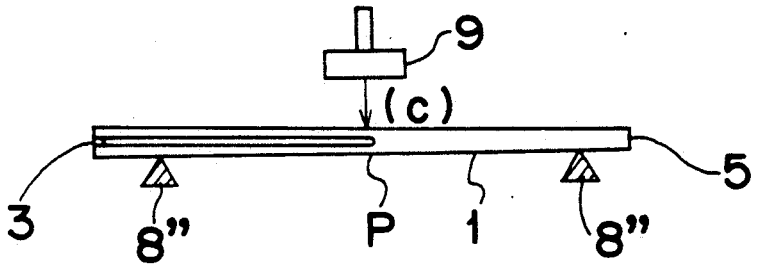

The rigidity in the main string direction Y1, rigidity in the cross string direction Y2, and rigidity in the ball striking direction X as referred to above are those respectively measured by measuring devices shown in FIGS. 3, 4 and 5.

More specifically, as shown in FIG. 3, for measuring the rigidity in the main string direction Y1, the opposite sides of the ball striking face between the side portions and the yoke portion of the frame 1 are fixed by support members 8 to hold the racket frame 1 vertically, and the load is applied to the top portion 3 by a pressure applying member 9 of 80 kgf, whereby a spring constant (rigidity) kgf/cm was obtained by the amount of deflection at that time. In the embodiment of FIG. 3, the rigidity (a) in the main string direction is set to be 70.0 kgf/cm.

As illustrated in FIG. 4, for obtaining the rigidity in the cross string direction Y2, the frame 1, directed laterally is vertically supported by disposing the side portion 2A on a fixed base 8', and the same load is applied onto the upper side portion 2B by the pressure applying member 9 for measurement. In the embodiment of FIG. 4, the rigidity (b) in the cross string direction is set to be 8.00 kgf.

As shown in FIG. 5, the rigidity in the ball striking direction X (ball striking face outer direction) is obtained in such a manner that, with the frame 1 held in a horizontal state, the under sides thereof in the vicinity of the top portion side and the grip end side are held by support members 8", and the same load was applied from above by the pressure applying member 9, onto a central point between the top portion 3 and the grip end portion 5 for measurement. In the embodiment of FIG. 5, the rigidity (c) in the ball striking direction is set to be 5.00 kgf/cm.

Therefore, with respect to the rigidity of the frame 1 in the embodiments as illustrated, "the rigidity (a) in the main string direction/the rigidity (c) in the ball striking direction" is 1.40, and "the rigidity (b) in the cross string direction/the rigidity (c) in the ball striking direction" is 1.60, and "the rigidity (a) in the main string direction/the rigidity (b) in the cross string direction" is 0.88, each of which is within the range of the above numerical values.

Moreover, the configuration of the side portions 2A and 2B, the top portion 3, and the yoke portion 4 are set as given below, and based on such settings, the sweet area SA shown by hatched lines in FIG. 1 is located at the central portion of the ball striking face F, while the center point P of said sweet area SA is set at the center position of the ball striking face F, i.e. at the position of the center point between the top portion 3 and the yoke portion 4.

More specifically, it is so set that the ratio of the radius of curvature R1 of the top portion 3/the radius of curvature R2 of the yoke portion of the frame 1 is in a range larger than 1.20 and smaller than 1.50, while the position WM which is the maximum width of the ball striking face F, is set at an upper position towards the top side portion 3 in the range of from 8% to 30% of the distance between the center point P and the top portion 3 in the striking face F.

It is to be noted here that the sweet area SA may be positioned at the central position of the ball striking face F by only setting the radius of curvature R1 of the top portion 3/the radius of curvature R2 at the yoke portion 4 in the range between a value larger than 1.20 and a value smaller than 1.50 as described above. Otherwise, it may be so arranged to set the position of the sweet area SA in the above described portion by setting the position for the maximum lateral width WM of the ball striking face F within the above range. Furthermore, as illustrated, by satisfy the both conditions, the position of the sweet area SA may be further displaced towards the top side portion 3, than in the conventional arrangements, as to be located at the central portion of the ball striking face F.

In the embodiments as illustrated, the settings are made as follows.

Radius of curvature R1 at the top portion 3=122.0 mm

Radius of curvature R2 at the yoke portion 4=88.5 mm,

R1/R2=1.38, which is in the range between the values larger than 1.20 and smaller than 1.50 referred to earlier.

Meanwhile, the position of the maximum width WM at the ball striking face is set to be at a position higher than the ball striking center point P by 22.0 mm. Since the length from the center point P to the top portion is 164 mm, the relation is 22/164=0.13, which falls within the range between 8 and 30%.

The set ranges of the frame rigidity and frame configuration as described above are obtained based on the following experiments as the optimum range from the viewpoint of the repulsion coefficient.

For experiments, the tennis racket frame for the embodiment of the present invention as shown in FIGS. 1 and 2, and also, tennis racket frames for comparative examples 1 to 5 as shown in Table 1 below were prepared.

In the comparative examples 1 to 5, all the factors except for the frame rigidity and ball striking face configuration shown in Table 1, i.e. frame weight, position of the center of gravity, frame total length, tension of the strings, etc. are set to be the same as those in the present embodiment.

The repulsion coefficient is represented by V2/V1, which is a ratio of the constant speed V1 of the ball struck out, to the Speed V2 of the ball struck back after collision with the racket frame stretched with the strings. In the measurements, balls of the same kind were employed.

Figure 6:
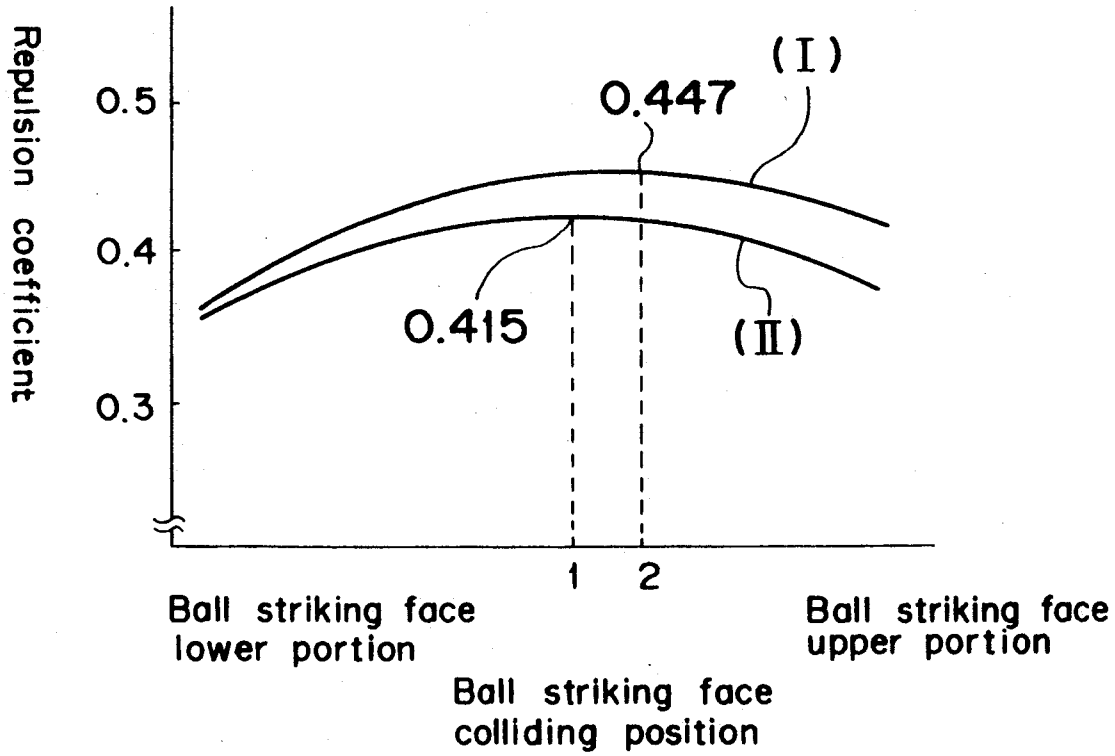
FIG. 6 is a graphical diagram showing repulsion coefficients according to positions within the ball striking face in the embodiment of the present invention and comparative examples.

FIG. 6, in which (I) represents the results of measurement on the racket frame of the embodiment, and (II) denotes the average value of the results of measurements on the comparative examples 1 to 5.

As shown in FIG. 6, the embodiment of the present invention shows the repulsion coefficient higher than

| | Rigidity | | | | | | | | |
|---|---|---|---|---|---|---|---|---|---|
| | Face inner/ Outer ratio | | | Ball striking face shape | | | | Repulsion Coeff. | |
| Example | Face inner ratio | Main string direct. | Cross string direct. | R ratio top/yoke | Max. lateral POS. (Remark 1) | Longi. Width L (mm) | Lateral Width W (mm) | Max. Value | Position to be max. (Remark 2) |
| Embod. | 0.88 | 1.40 | 1.60 | 1.38 | +13.4% (+22.0 mm) | 328.0 | 249.6 | 0.447 | +1.0 |
| Compar. 1 | 1.47 | 1.34 | 0.91 | 1.15 | +0.1% (+0.2 mm) | 323.4 | 237.5 | 0.410 | −43.0 |
| Compar. 2 | 1.20 | 2.45 | 2.05 | 1.15 | +0.1% (+0.1 mm) | 319.2 | 238.6 | 0.415 | −47.0 |
| Compar. 3 | 0.77 | 0.72 | 0.94 | 1.01 | −1.9% (−3.1 mm) | 321.7 | 242.0 | 0.415 | −75.0 |
| Compar. 4 | 1.48 | 1.31 | 0.89 | 1.27 | +7.2% (+12.1%) | 338.2 | 247.0 | 0.429 | −25.0 |
| Compar. 5 | 1.68 | 3.23 | 1.93 | 1.13 | −3.1% (−5.0 mm) | 323.2 | 233.0 | 0.405 | −33.0 |

(Remark 1) Distance from ball striking face center (mm): +; upper direction, −; lower direction (Remark 2) Distance from ball striking face center (mm): +; upper direction, −; lower direction As shown in Table 1 above, the repulsion coefficient in the embodiment is much larger than those in the comparative examples 1 to 5. In the comparative examples of Table 1, the items outside the above range of values are underlined for attention. As is seen from Table 1, each of the comparative examples from 1 to 5 is deviated in the point of the frame rigidity from the range of values according to the present invention, and with respect to the R ratio also, the results of the comparative examples 1 to 5 are outside the range of values of the present invention except for the comparative example 4. Similarly, in the maximum lateral width positions of the ball striking face also, the results of all of the comparative examples are out of the range of values of the present invention. Therefore, in the racket frame in each of the comparative examples 1 to 5, the repulsion coefficient is much inferior to that according to the present invention.

In the embodiment, the position where the repulsion coefficient becomes a maximum is located generally at a center point in a position higher than the center point of the ball striking face by 1 mm, with the sweet area being located at a central portion of the ball striking face and the striking point, at the center of the ball striking face. In other words, as shown in the comparative example coinciding with the conventional example, the sweet area located at the position lower than the center of the ball striking face is displaced to the upper side where the rotational speed is increased during the swing. Therefore, upon striking by the sweet area of the embodiment, the repulsion performance may be further improved by effectively utilizing the rotational speed of the racket frame during the swing.

Furthermore, distribution of the repulsion coefficients on the ball striking face is also measured based on the experiments, and the results thereof are shown in FIG. 6, in which (I) represents the results of measurement on the racket frame of the embodiment, and (II) denotes the average value of the results of measurements on the comparative examples 1 to 5.

As shown in FIG. 6, the embodiment of the present invention shows the repulsion coefficient higher than that of the comparative examples at any position of the ball striking face, while the position of maximum repulsion coefficient of the embodiment is further displaced towards the upper side of the ball striking face than in the comparative examples. It is to be noted here that in FIG. 6, the position for 1 in the abscissa represents the position of the center point P of the ball striking face.

As is clear from the foregoing description, according to the present invention, since the rigidity of the racket frame is improved not only by improving the rigidity ratio in the main string direction to the cross string direction, but by setting the ratio of the rigidity in the ball striking face inner direction to the rigidity in the ball striking face outer direction, within a proper range of values for the improvement of repulsion performance, the flying performance can be advantageously improved.

Moreover, owing to the fact that the sweet area has been displaced towards the upper side where the rotational speed of the racket frame during the swing is increased, the repulsion performance may be further improved through effective utilization of said rotational speed. When the sweet area is moved towards the upper side, the performance of the racket frame may be more effectively displayed in serve play in which the ball is struck at the upper side of the ball striking face.

Although the present invention has been fully described by way of example with reference to the accompanying drawings, it is to be noted here that various changes and modifications will be apparent to those skilled in the art. Therefore, such changes and modifications are not considered to depart from the scope of the present invention and as such should be construed as included therein.

What is claimed is:

1. A tennis racket which comprises a main frame portion having an oval shape which is defined by a top portion, side portions, and a yoke portion; a grip portion contiguous with the yoke portion, and a netting stretched in the oval main frame by main strings and cross strings to form a ball striking face with a sweet area provided therein, wherein the ratio of the rigidity in the main string direction to the rigidity in the ball striking direction, and the ratio of the rigidity in the cross string direction to the rigidity in the ball striking direction, are each set to be larger than 1.00 and smaller than 2.00, and the rigidity ratio of the frame within the ball striking face comprising the ratio of the rigidity in the main string direction to the rigidity in the cross string direction of said strings is set to be smaller than 1.00.

2. The tennis racket as claimed in claim 1, wherein said racket is formed to have a shape in which the ratio of a radius of curvature at the top portion to a radius of curvature at the yoke portion is in a range larger than 1.20 and smaller than 1.50.

3. The tennis racket as claimed in claim 1, wherein a position of maximum lateral width for the ball striking face is established between the central point of the ball striking face and the top portion of the frame, and falls within the range of 8 to 30% of the distance from said central point to said top portion of the frame.

4. A tennis racket which comprises a main frame portion having an oval shape which is defined by a top portion, side portions, and a yoke portion; a grip portion contiguous with the yoke portion, and a netting stretched in the oval main frame by main strings and cross strings to form a ball striking face with a sweet area provided therein, wherein the ratio of the rigidity in the main string direction to the rigidity in the ball striking direction, and the ratio of the rigidity in the cross string direction to the rigidity in the ball striking direction, are each set to be larger than 1.00 and smaller than 2.00, and the rigidity ratio of the frame within the ball striking face comprising the ratio of the rigidity in the main string direction to the rigidity in the cross string direction of said strings is set to be smaller than 1.00, said racket being formed to have a shape in which the ratio of the radius of curvature at the top portion to a radius of curvature at the yoke portion is in a range larger than 1.20 and smaller than 1.50, with a position of a maximum lateral width for the ball striking face being established, between the central point of the ball striking face and the top portion of the frame, and falls within the range of 8 to 30% of the distance from said central point to said top portion of the frame.

* * * * *